United States Patent [19]

Miller

[11] Patent Number: 4,489,450

[45] Date of Patent: Dec. 25, 1984

[54] BODY SUPPORT FOR BED OR SEAT

[75] Inventor: John E. Miller, Tupelo, Miss.

[73] Assignee: Parma Corporation, Denton, N.C.

[21] Appl. No.: 367,874

[22] Filed: Apr. 13, 1982

[51] Int. Cl.[3] ..... A47C 23/02

[52] U.S. Cl. ..... 5/250; 5/249; 5/12 R; 5/13

[58] Field of Search ..... 5/12 R, 13, 28, 29, 5/44 R, 240, 249, 250, 446, 447; 267/103–110

[56] References Cited

U.S. PATENT DOCUMENTS

| | | | |
|---|---|---|---|
| 332,081 | 12/1885 | Jeffery et al. | 5/249 |
| 927,982 | 7/1909 | Klipfel | 5/249 |
| 2,634,427 | 4/1953 | Wodarsky | 5/13 A |
| 2,773,270 | 12/1956 | Rozelle | 5/447 |
| 2,874,390 | 2/1959 | Stone | 5/447 |
| 2,974,326 | 3/1961 | Ross | 5/447 |
| 3,085,259 | 4/1963 | Sandor | 5/447 |
| 3,892,001 | 7/1975 | Schneider | 5/13 |
| 4,003,564 | 1/1977 | Taylor | 267/108 |
| 4,050,738 | 9/1977 | Griffiths | 267/103 |
| 4,069,525 | 1/1978 | Valoff | 267/105 |
| 4,120,058 | 10/1978 | Kitchen | 267/103 |
| 4,377,279 | 3/1983 | Schulz | 5/250 |

*Primary Examiner*—Alexander Grosz
*Assistant Examiner*—Michael F. Trettel
*Attorney, Agent, or Firm*—William E. Mouzavires

[57] ABSTRACT

A body support for a bed or a seat having a plurality of resilient support members or springs that are movable between a retracted or collapsed, inoperative position and an extended, operative position. The springs are contained in a case of flexible sheet material so that when the springs are collapsed, the case is collapsed or depressed into a relatively thin layer for storage or other purposes; and when the springs are extended the case will be distended by the springs to provide a resilient support such as a mattress, "box-spring" or a combination thereof for use in a bed or seat. Actuating means is provided for actuating one or more of the springs between the retracted and extended positions thereof, and a connecting means interconnects all of the springs to drive them from the retracted to extended positions. The body support is especially suited to sofa beds or other foldable bed or seat structures because, in this application, the folding parts of the latter structures are coordinated with the body support such that when the bed is folded into the storage position, the springs will simultaneously be moved to their collapsed position contracting the surrounding case into a relatively thin layer, thus enabling the body support to be stored within the confines of the associated structure. Conversely, when the sofa bed is unfolded to form a bed, the springs will move to their extended position to provide resilient support.

45 Claims, 26 Drawing Figures

12
105
110a
112a
134
132
130
104
124
120
100
102
106
101
110
114
112
136
142
121
122
106

BODY SUPPORT FOR BED OR SEAT

BACKGROUND OF INVENTION

Sofa beds, convertible sleepers, seat beds and other foldable bed or seat units suffer from the fact that their mattresses are necessarily limited in depth to say, for example, a maximum of two and three-quarter inches (2¾") for tri-fold beds and four inches (4") for standard sleepers. This drawback is caused by the requirement of the mattress to fold into the limited confines of the frame which is typically designed to provide low seat height requirements which therefore place a definite limitation on the size of the mattress depth.

The result is that the mattress, when unfolded to be used as a body support for sleep, does not provide the needed comfort and support to the body. On the contrary, the mattress is uncomfortable to the sleeper and also tends to hammock through use thereby increasing the discomfort while shortening the life of the mattress.

The aforementioned problem also has placed a limitation on the styling of sofa beds or convertible sleepers or seat beds so that it has been heretofore difficult if not impossible, to provide a low seat style in keeping with present-day tastes and at the same time, a mattress of sufficient depth to provide the necessary comfort and support to the user.

OBJECTS OF THE PRESENT INVENTION

One of the objects of the present invention is to provide a novel body support that may be used as a mattress or a "box-spring" or a combination of the two but which may be stored in a depressed condition until needed, whereupon it may be distended to provide effective support and comfort to the user. Included herein is a body support such as a mattress or a "box-spring" or a combination of the two, that may be shipped or stored in a compact retracted condition of minimum depth dimension and yet prior to use, may be expanded to a full depth dimension to provide necessary body support and comfort.

A further object of the present invention is to provide such a body support that may be used as a mattress or "box-spring" or a combination thereof, in various types of beds, seat beds, sofa beds, etc. of various designs including present-day low seat styling. Included herein is the provision of such a body support that may be made in various sizes and thicknesses to suit particular needs or designs.

Another object of the present invention is to provide a body support such as a mattress or "box-spring" or a combination of both, for use in a sofa bed or seat bed or other foldable bed or seat structure, which body support may be designed with sufficient depth to provide high comfort and effective support to the user but without impairing the overall design of the structure and particularly the desired seat height when the structure is converted for use as a seat or sofa.

Another object of the present invention is to provide a novel and improved sofa bed or seat bed or similar structure which is convertible into a bed and yet will have a full size mattress that will provide high comfort and effective support to the user. Included herein is such a convertible sofa bed or seat bed unit incorporating a mattress or "box-spring" or a combination of both, that will automatically be collapsed or depressed along its depth dimension upon conversion of the unit into a seat or sofa, thus enabling storage of the body support within the unit. Further included herein is such a sofa bed or seat bed unit incorporating such a body support that will automatically be distended into a full size mattress or "box-spring" or combination of the two, upon conversion of the unit from a sofa or seat to a bed.

A still further object of the present invention is to provide a body support of the type described above and which utilizes resilient members such as springs to provide effective resilient support. Included herein is such a body support including an outer sheet-like covering or case enclosing springs which may be moved from an inoperative, collapsed or retracted condition to an operative, extended condition for expanding the body support including the case into proper size for use as a mattress or a "box-spring" or a combination of both.

SUMMARY OF INVENTION

In summary, the present invention in one aspect, is a body support including a plurality of resilient, spring-like members or springs that are contained in a case preferably of flexible sheet-like material for movement between an inoperative, collapsed or retracted condition to an operative, extended condition. In the collapsed condition, the case with its springs is in a depressed state of minimum depth providing a compact body ideal for storage. In the extended or operative condition, the case is expanded to a maximum depth with the springs oriented to provide resilient support.

In accordance with another aspect of the invention, the body support is incorporated in an improved sofa bed or seat bed unit to provide the mattress or "box-spring" or combination thereof, for the unit. In this application, the springs are operatively coordinated with folding parts of an associated frame such that when converted from the bed mode to the sofa or seat mode, the body support will be automatically depressed as it is folded on itself, into relatively thin layers with the springs in their collapsed or retracted condition, enabling the body support to be folded and stored within the given confines of the unit. Conversely, upon conversion from the sofa or seat mode to the bed mode, the body support will be automatically expanded into a full size mattress or "box-spring" or a combination of the two, with the springs projected into an operative orientation to provide the necessary support and comfort to the user.

DRAWINGS

Other objects and advantages of the present invention including several specific applications or embodiments thereof will be described in detail below in conjunction with the attached drawings in which.

DETAILED DESCRIPTION

The Prior Art

Figure 1:
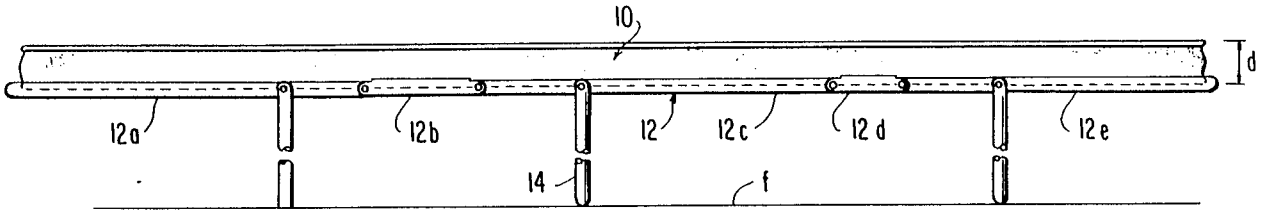
FIG. 1 PRIOR ART
FIG. 1 is a side elevational view in diagrammatic fashion, of portions of a sofa bed constructed in accordance with the prior art and shown in the unfolded condition where it is of course in the bed mode.
Figure 2:
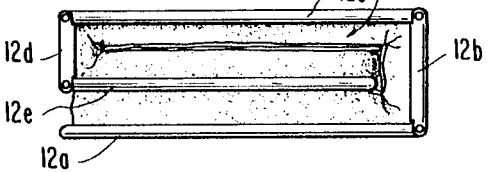
FIG. 2 PRIOR ART
FIG. 2 is a side elevational view of the sofa bed of FIG. 1 in the fully folded condition assumed while in the sofa mode.

Referring now to the drawings in detail, and initially to FIG. 1, there is illustrated a foldable bed structure such as a sofa bed or couch bed, including a mattress or pad 10 fully spread or unfolded in the bed position, and a foldable frame 12 supporting the mattress 10 by means of a layer of springs (not shown) attached to the frame 12. Such a structure is of course well-known in the prior art, the frame 12 including a plurality of frame elements 12*a*, 12*b*, 12*c* and 12*e* pivotally interconnected to be movable from a generally horizontal plane shown in FIG. 1 to a folded position shown in FIG. 2. In the latter condition, the mattress 10 has, of course, also been folded into a plurality of overlying layers within the confines of the frame elements 12*a*, *b*, *c*, *d*, and *e*. The frame further typically includes legs 14 which are pivotally connected to the frame elements to be movable between the extended positions shown in FIG. 1 where they rest on the underlying floor f, and retracted positions not shown. Because the structure, when in the folded condition shown in FIG. 2, must fit into an associated sofa or couch frame, for example, to provide a seat, the depth d of the mattress 10 must be limited in size in order to achieve the desired seat styling of the associated couch or sofa. Such a mattress 10, because of its limited depth d, often fails to provide the necessary comfort and support to the user. The mattress also tends, with use, to "hammock" in shape to further lessen the comfort and support to the user while also shortening the useful life of the mattress.

The Present Invention

Figure 3:
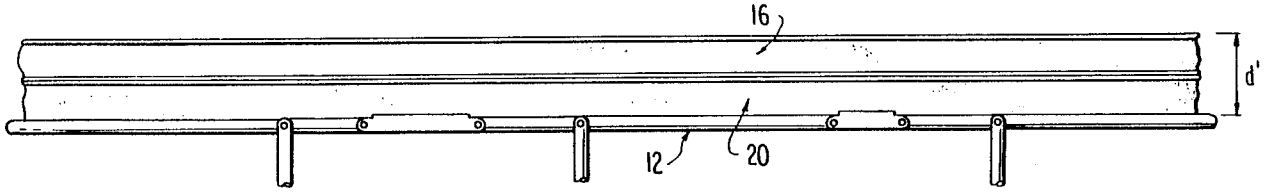
FIG. 3 is a side elevational view of a sofa bed embodying the present invention and shown in the fully unfolded bed mode but with certain parts removed for clarity.

Referring now to FIG. 3, there is illustrated a sofa bed having a frame similar to the conventional frame described above and shown in FIGS. 1 and 2 with the exception of the spring layer supported within the conventional frame which layer is eliminated by the present invention. However, the present sofa bed incorporates novel and improved body support in accordance with the present invention which overcomes the aforementioned drawbacks of conventional sofa beds and similar structures. In the particular embodiment shown in FIG. 3, the body support includes a mattress or pad 16 which may have any conventional construction similar to mattress 10 described above, and an underlying body support 20, for example, such as may be referred to as a "box-spring", the latter being supported on frame 12. Note depth d' of the body support in the present instance is increased considerably as shown in FIG. 3 to provide high comfort and effective support to the user. This is achieved in accordance with the present invention without changing the shape or dimensions of the associated foldable frame 12 or the seat-height styling of the associated couch or sofa by virtue of the construction of the box-spring 20 which is collapsible into a depressed, relatively thin, layer shown in FIG. 6 when the sofa bed is folded into the seat mode. Box spring 20 is also expandable into a full depth useful condition shown in FIG. 3 when the sofa bed is moved into the bed mode shown in FIG. 3. One preferred embodiment of the body support 20 will now be described in conjunction with FIGS. 4 through 9F.

The Spring System

Figure 5:
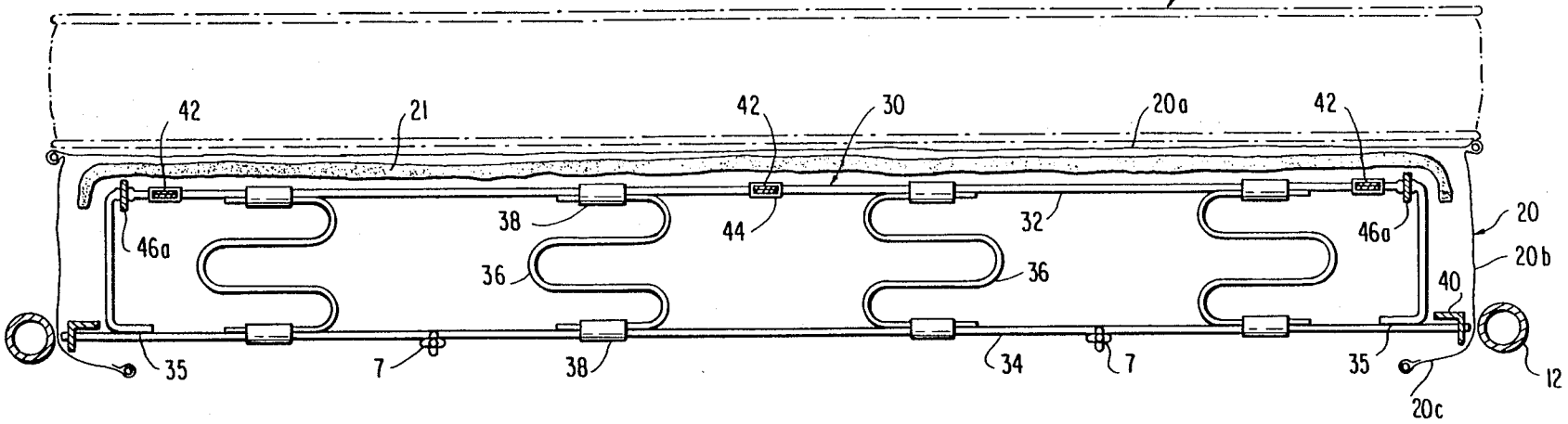
FIG. 5 is a transverse, cross-sectional view taken generally along lines 5—5 of FIG. 4.
Figure 4:
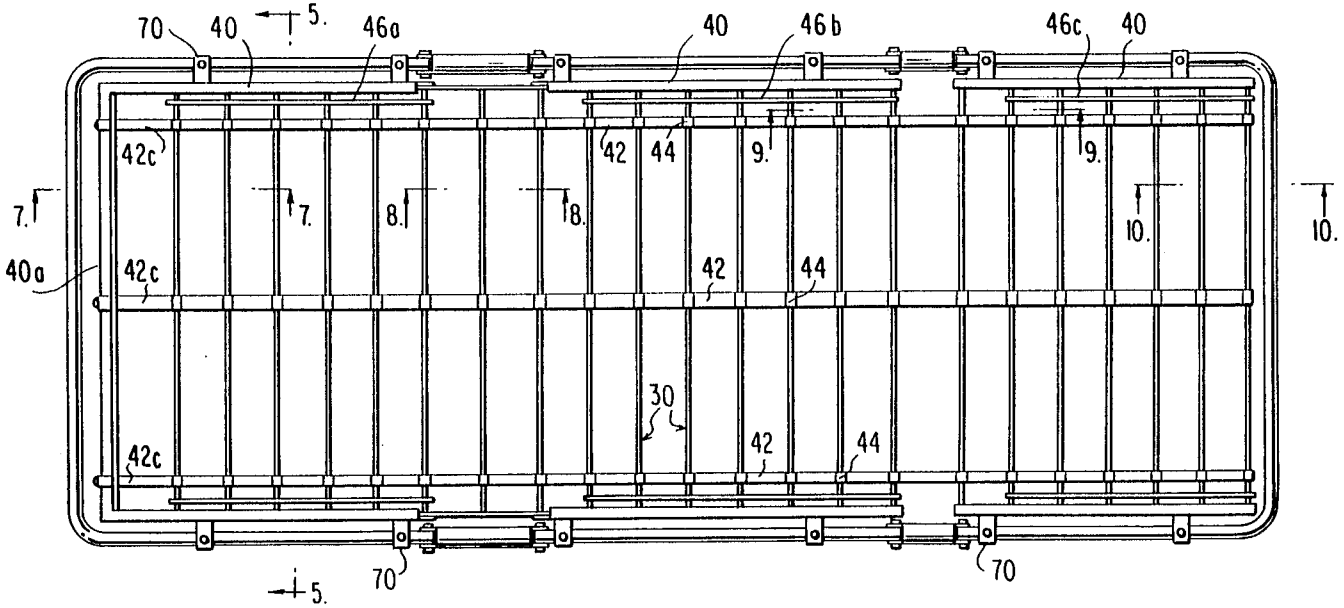
FIG. 4 is a plan view of the bed of FIG. 3.

Body support 20 includes a unique spring system enclosed by a flexible case. Referring now to FIGS. 4 and 5, the spring system includes a plurality of spring-like members or springs generally designated 30 mounted within an associated frame, hereinafter referred to as the "spring frame", to extend generally parallel to each other in side-by-side spaced relationship, transversely and throughout the length of the bed frame. As best shown in FIG. 5, each of the springs 30 in the specific embodiment includes upper and lower wire or rod members 32 and 34 which may be fixed together in any suitable manner, such as by welding, at 35 to form a generally rectangular structure. Fixed to and extending between upper and lower spring portions 32 and 34, in the same plane, are a plurality of sinusoidal or S-shaped portions 36 which are spaced from each other throughout the length of portions 32 and 34 as shown in FIG. 5 in accordance with the desired support to be achieved. S-shaped spring portions 36 may be fixed to upper and lower spring portions 32, 34 in any suitable manner, for example, through welding or through the use of the clamps 38 shown in FIG. 5. Spring portions 32, 34 and 36 are made from any suitable spring-steel wire or resilient rod-like material of suitable gauge. Furthermore, although one specific spring construction, configuration and arrangement is shown in FIG. 5, it will be obvious to those of ordinary skill in the art that other spring shapes, constructions and arrangements may be employed in carrying out the present invention. Similarly, the number and spacing of springs 30 throughout the length of the body support may be designed to provide the desired degree of support. Also, the depth or height of the springs 30 may be designed depending upon the depth of the box-spring desired.

Figure 6:
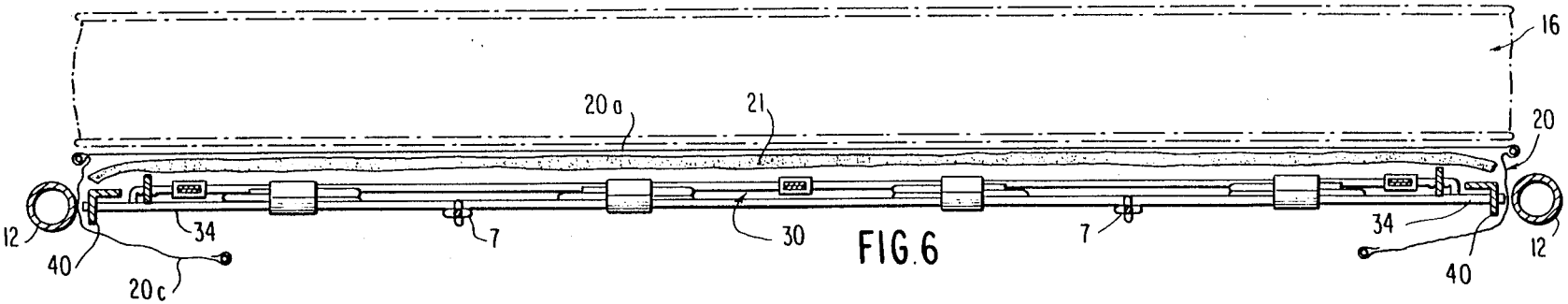
FIG. 6 is a view generally similar to FIG. 5 except illustrating the body support of the present invention (applied as a box-spring) in its collapsed, inoperative condition.
Figure 7D:
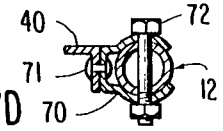
FIG. 7D is a fragmental, cross-sectional view taken generally along lines 7D—7D of FIG. 7C.
Figure 7A:
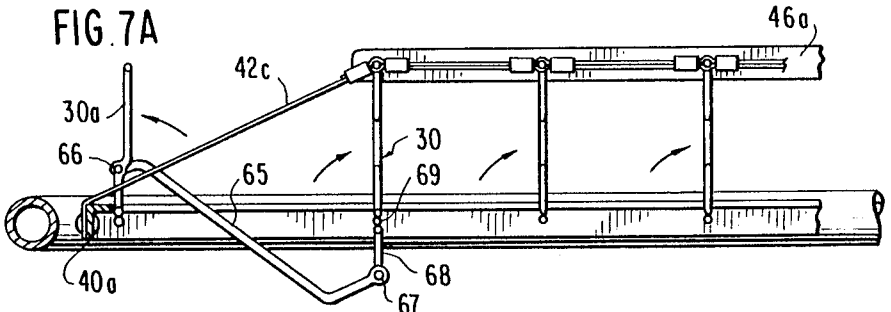
FIG. 7A is a fragmental, cross-sectional view taken generally along lines 7—7 of FIG. 4 when the sofa bed is in the bed mode with the body support illustrated in expanded, operative condition.
Figure 7B:
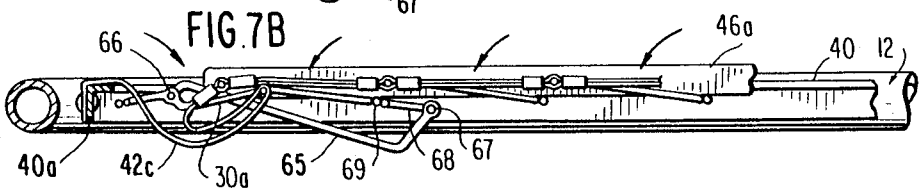
FIG. 7B is a view generally similar to FIG. 7A except illustrating the body support in the collapsed or depressed, inoperative condition.

Springs 30 are mounted in a surrounding spring frame for movement between a collapsed or retracted position shown in FIGS. 6 and 7B where they extend in generally the same plane, and an extended or erect position shown in FIGS. 5 and 6 where they project generally normal to the aforementioned plane. The retracted position is for the purpose of reducing the depth of the body support for storage or to permit it to be folded into the confines of the associated sofa bed when the latter is folded into the sofa mode. The extended position of the springs 30 is for providing a resilient body support for a bed.

Figure 8A:
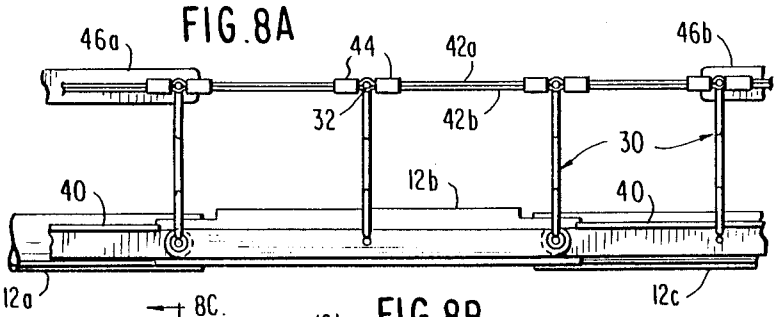
FIG. 8A is a fragmental, cross-sectional view taken generally along lines 8—8 of FIG. 4.
Figure 8B:
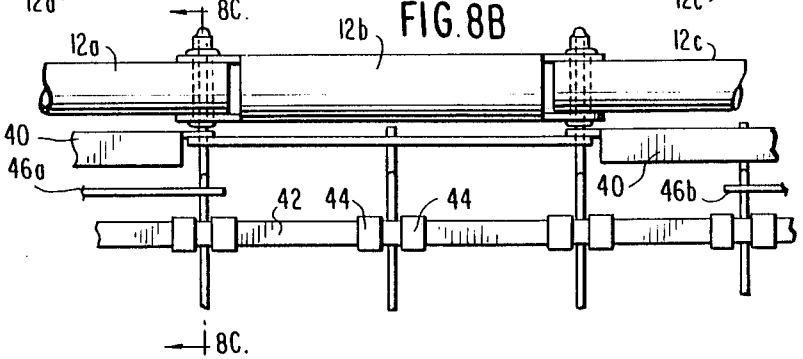
FIG. 8B is a plan view of the parts shown in FIG. 8A.
Figure 8C:
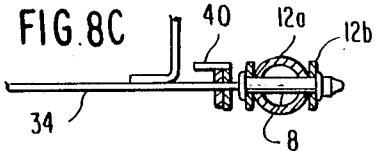
FIG. 8C is a cross-sectional view taken generally along lines 8C—8C of FIG. 8B.

In the specific embodiment shown, the spring frame includes a plurality of elongated channel elements 40 of any suitable structure such as, for example, steel channel members including side frame members 40 extending along opposite ends of the spring 30, and a cross frame 40*a* (see FIG. 4) extending transversely at the head of the frame 12 while being suitably fixed to opposite side frame members 40. As seen in FIG. 4, in the specific embodiment being described, the side frame members 40 are provided in three sections on each side of the spring to correspond with the sections 12*a*, 12*c* and 12*e* of the main frame 12 to be foldable with the latter. In the specific embodiment shown, springs 30 are mounted for pivotal movement within spring frame 40 through the provision of a plurality of apertures provided in spring frame sections 40 to receive the ends of the lower portions 34 of the springs 30 as best shown in FIGS. 5 and 6. If desirable, some or all of the springs 30 may also be mounted in the main frame 12 such as illustrated in FIGS. 8B and 8C where the springs are mounted through the pivots between sections 12*a*, 12*b* and 12*c* of the main frame 12. This may be effected by utilizing hollow rivets or other suitable means which are inserted through apertures in the main frame sections 12 and secured in place with the ends of the lower portions 34 of the spring 30 secured within the hollow rivets 8.

Figures 9A, 9B, 9C, 9D, 9E, 9F, 10A, 10B:
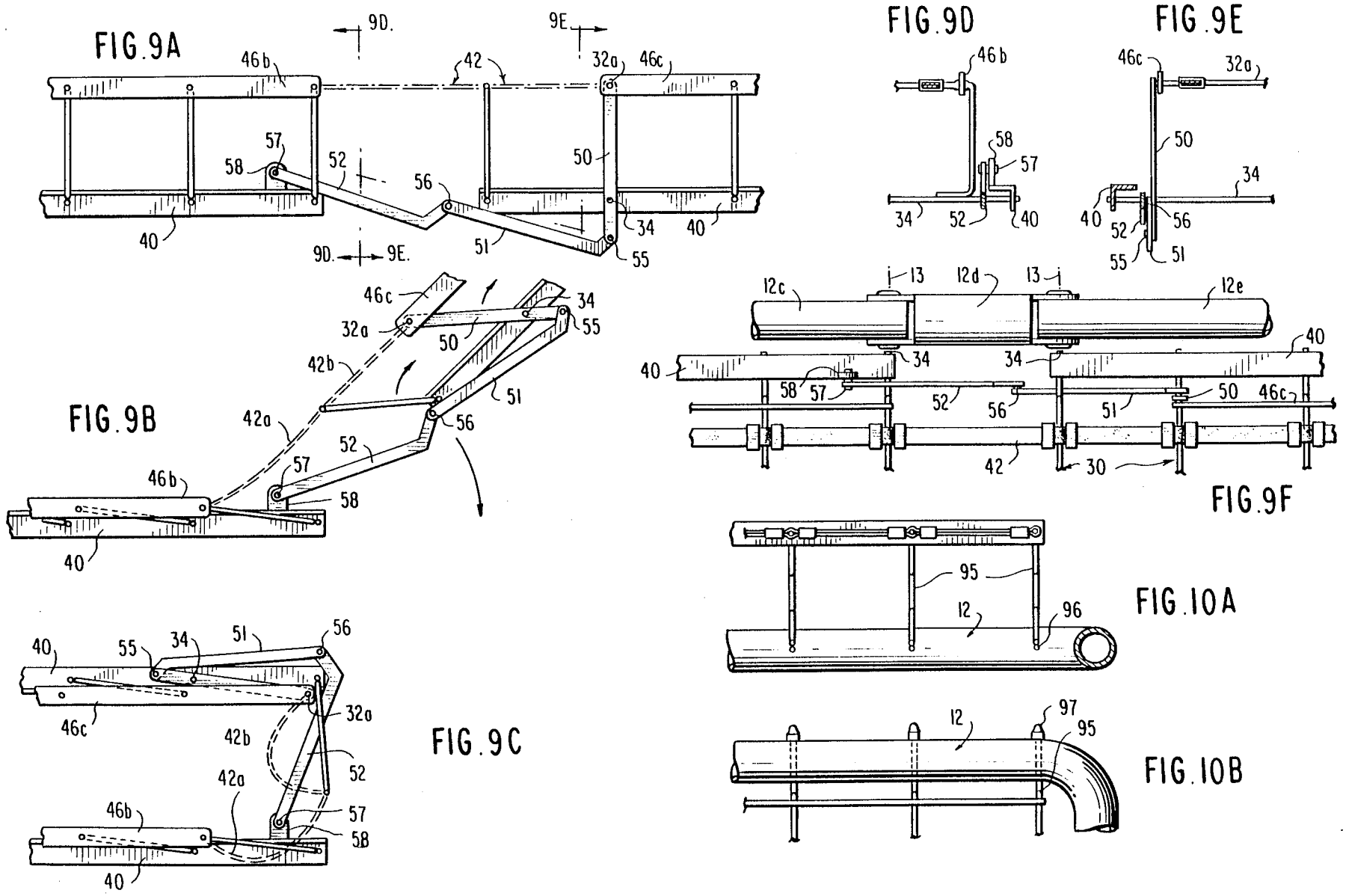
FIG. 9A is a cross-sectional view taken generally along lines 9—9 of FIG. 4 to illustrate a linkage actuating system shown in the position when the sofa bed is in the fully unfolded, bed mode.
FIG. 9B is a view generally similar to FIG. 9A except the parts are shown with the sofa bed in a position intermediate the sofa and bed modes.
FIG. 9C is a view generally similar to FIG. 9B except the parts are shown with the sofa bed in the fully folded or sofa mode.
FIG. 9D is a cross-sectional view taken generally along lines 9D—9D of FIG. 9A.
FIG. 9E is a cross-sectional view taken generally along lines 9E—9E of FIG. 9A.
FIG. 9F is a plan view of the parts shown in FIG. 9A.
FIG. 10A is a fragmental, side elevational view of a portion of a sofa bed of modified construction.
FIG. 10B is a plan view of the parts shown in FIG. 10A.

As will be seen from FIG. 9F the lower portions 34 of certain springs 39 are aligned with the axis 13 of the pivots which interconnect the main frame sections 12*c*, 12*d* and 12*e*. The same is true of course for the springs that are mounted in the pivots of the sections 11*a*, *b*, and *c* as shown in FIG. 8B and described above. This assures that the folding of the spring unit will be coordinated with the folding of the main frame 12.

Referring to FIGS. 4 and 5, each of the springs 30 is interconnected by connecting members or ties to be movable together. In the particular embodiment shown, the connecting members are provided by strapping such as steel, fiberglas or other flexible strapping of suitable strength generally designated 42 which extends transversely over each of the springs 30 as shown in FIG. 4 where it is connected to the upper portions 32 of the springs in any suitable manner, for example, through means of clamps generally designated 44 in FIGS. 4 and 5. It will be noted from FIGS. 4 and 5 that in the specific embodiment shown, three runs of the connecting members in the form of strapping generally designated 42, are employed across the upper portions 32 of the springs; the strapping 42 being spaced from each other as shown in FIG. 4 with the center strapping being located approximately along the center line of the spring unit. Referring now to FIGS. 8A and 8B it will be noted that in the specific application of the strapping 42, upper and lower strapping 42*a* and 42*b* are employed in coextensive and superimposed relationship, to extend on opposite sides of the upper portion 32 of each spring where they are secured together on opposite sides of each upper portion 32 by means of a pair of clamps 44. It will be seen that the connecting members 42, whether they be in the form of the strapping shown or other connecting means, will also serve to enhance the support of the spring unit and to integrate the springs into a spring system. Of course, the number of spring connecting members 42 and their spacing relative to each other may be varied to achieve any desired support characteristics.

Spring Actuation

As noted above, springs 30 are movable between a collapsed, retracted, inoperative position shown in FIGS. 6 and 7B to an extended, erect or operative position shown in FIGS. 5, 7A and 9A. Referring to FIG. 7A, the extended or operative position of springs 30 is limited and defined by the endmost strap portions 42*c* which are anchored to spring frame member 40*a* at the head of the unit to prevent the springs 30 from moving beyond (to the right as viewed in FIG. 7A) their erect positions shown in FIG. 7A. With the exception of the endmost spring 30*a* located at the head of the bed (see FIG. 7A), all of the springs 30 move in the same directions when moving to their erect or retracted position. Endmost spring 30*a* is actuated between retracted and erected positions by virtue of a connecting link 65 having one end portion pivoted at 66 to an intermediate portion of endmost spring 30*a* and having its opposite end portion pivoted at pivot 67 to a depending portion 68 of the next adjacent spring 30; the dependent portion 68 being fixed to or formed as part of the associated spring 30 so as to be movable with spring 30 as a unit about a pivot axis shown at 69 in FIG. 7A which coincides with the axis of the lower spring portion 34 shown in FIG. 5. It will thus be seen that when springs 30 move to their erected position, link 65 will pivot endmost spring 30*a* into its erect position moving in a counterclockwise direction as viewed in FIG. 7A opposite to the clockwise direction of movement of springs 30. Conversely, when springs 30 are moved to their retracted position, link 65 will actuate endmost spring 30*a* to its retracted position moving in a direction opposite to that of springs 30. In order to avoid interference between endmost spring 30*a* and the next adjacent spring 30 when moving between the opposite positions thereof, endmost spring 30*a* is formed in offset planes as viewed in FIG. 7A which will cause endmost spring 30*a* to pivot into its retracted position in advance of the path of movement of the next adjacent spring 30. In other embodiments (not shown) the endmost spring 30*a* may be eliminated as the distance between the last spring 30 at the head of the unit and the spring frame 40*a* or frame 12 at the head of the bed may be reduced in size.

In order to further strengthen and unify the spring system in the specific embodiment being described, a plurality of elongated reinforcing members 46*a*, 46*b* and 46*c* are provided across the upper spring portions 32 at their opposite ends as shown in FIG. 4. These reinforcing members may be provided by any suitable elements, for example, elongated steel bars as shown, which are provided with apertures which receive the upper portions 32 of the springs 30 as best shown in FIG. 5. Although in some embodiments, the reinforcing members 46*a* and 46*b* may be considered optional depending on the number of connecting members 42 employed, it should be noted that the members 46*c* at the foot of the bed in the specific embodiment shown, are not optional in the present embodiment inasmuch as they also provide an actuation function to be described below.

In order to actuate springs 30 from their retracted to their extended positions, an actuation mechanism is provided which in the specific embodiment being described applicable in connection with sofa beds, preferably includes a linkage including links 50, 51 and 52 illustrated in FIG. 9A. As viewed in FIGS. 9A and 9E, the upper end portion of link 50 is pivoted about the upper portion 32*a* of one of the springs in the foot section of the spring system. This is achieved in the specific embodiment through an aperture in link 50 receiving the upper member 52*a* of spring 30. Link 50 is further pivoted at a lower end portion thereof with respect to the adjacent spring frame 40 by means of the lower member 34 of the adjacent spring 30. Link 50 has a portion depending below its pivot at 34 and being pivoted at 55 to one end of link 51. The opposite end of link 51 is pivoted at 56 to link 52 which, in turn, is pivoted at 57 to a lug 58 fixed to spring frame section 40. In view of the association of link 50 with the adjacent spring 30, it will be seen that when the spring system is moved from the folded position shown in FIG. 9C to the fully unfolded position shown in FIG. 9A, link 50 will be actuated through links 51 and 52 causing the associated spring 30 to move with link 50 in the clockwise direction as viewed in FIGS. 9B and 9A into the erect position shown in FIG. 9A. At the same time, link 50 will cause reinforcing channel 46*c* which is connected to the remaining springs 30 in the foot section of the spring system, to actuate these springs into the erect position.

In view of the connection of the remaining springs 30 through means of strapping 42, to the springs 30 in the foot section of the unit, the remaining springs will also be actuated to their erect positions by virtue of forces transmitted through the strapping 42. Furthermore, the endmost spring 30*a* at the head of the unit will be moved to its erect position by virtue of the link 65 as was described above, see FIG. 7A.

When in their erect position shown in FIG. 9A, pivots 55, 56 and 57 will be in line with each other to thus maintain the springs 30 in their erect position against movement back to their retracted position by any forces that would act on link 50 when the body support is in its horizontal position with the springs erect. Furthermore, while in their erect position, springs 30 will be maintained against movement beyond their erect position that is, to the right as viewed in FIG. 7A, by virtue of the end strapping portions 42*c* as was described above.

When the spring unit is folded upon itself from the horizontal position shown in FIG. 9A through the intermediate position of 9B and to the fully folded position of 9C, the spring 30 associated with link 50 will move towards retracted position together with the link 50, thereby retracting the remaining springs 30 in the foot section of the unit which retraction will be enhanced by the weight of the upper pad or mattress 16 (see FIG. 3). Furthermore, strap sections 42*a* and 42*b*, as seen in FIGS. 9B and 9C, will become slackened after a certain point, thereby permitting the remaining springs 30 to move to their retracted positions by virtue of the geometry of the spring frame sections 40, the strapping 42, the linkage 50, 51 and 52 and also by virtue of forces emanating from the outer mattress or pad 16 which will move the springs 30 into their retracted position. It should be noted that the aforementioned movement of the springs between their extended and retracted positions occurs automatically when the user unfolds or folds the bed frame sections 12 in accordance with conventional practice. That is to say, for example, assuming the sofa bed is in the bed mode shown in FIG. 3, the foot section of the bed is grasped by the user and folded over in the conventional manner into the position shown, for example, in FIG. 2 which position corresponds to that of FIG. 9C except that in the latter, the mattress and box-spring portions have been removed for clarity. Although only one actuating linkage 50, 51 and 52 has been shown, another identical linkage may be employed on the other side of the structure.

The Case

As noted above, the spring unit 20 in the specific embodiment being described is utilized as a box-spring as illustrated in FIG. 3. Therefore, the spring unit is provided with a suitable case made from any suitable flexible and durable sheet-like material which may include conventional ticking or other materials. The case includes a top section 20*a*, opposite side and end sections 20*b* and bottom sections 20*c* which enclose the spring system as best shown in FIG. 5. Preferably, the top section 20*a* is made from a strong and durable material such as polyethylene. The remaining sections may also be made from polyethylene. Additionally, it is preferred that a buffer layer 21, formed of any suitable foam or other cushion material, be located over the top of the springs 30 between the latter and the top section 20*a* of the case as shown in FIGS. 5 and 6. This will reduce wear on the underside of the top section 20*a* while also serving to cushion the springs 30. Although the spring case in the shown embodiment does not completely enclose the bottom of the spring unit, the bottom case section 20*c* may, of course, be designed to entirely enclose the bottom of the spring unit. It will thus be seen that the case in the shown embodiment encloses the spring 30 as well as the spring frame 40. The body support 20 may therefore be supplied in various sizes as a separate item for use on new, old or conventional beds, sofa beds, seat beds, etc., to which it may be mounted in several different ways as will be described below.

Mount Of The Body Support To The Main Frame

Figure 7C:
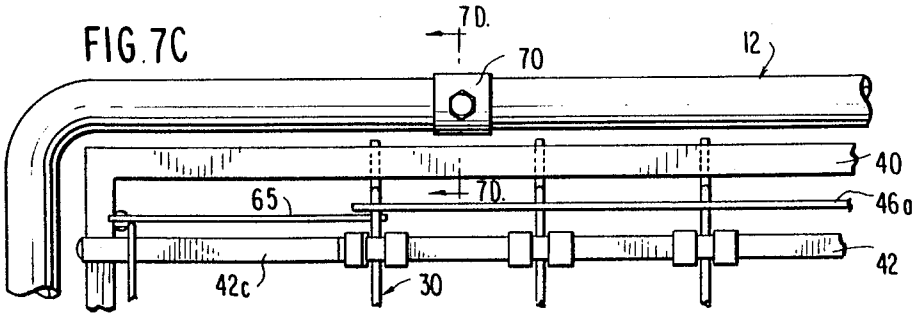
FIG. 7C is a plan view of the parts shown in FIG. 7A.

Referring now to FIGS. 4, 7C and 7D, the body support 20 may be mounted to the sections 12*a*, 12*b*, 12*c* and 12*e* of the main frame 12 in any suitable manner, for example, through the use of C-clamps 70 fixed, such as by rivet 71, to the spring frame portions 40 while being clamped about main frame 12 and secured in place through a nut and bolt assembly 72 (see FIG. 7D). As shown in FIG. 4, such assemblies are provided at a plurality of locations along the sections of the main frame 12. Other methods of mounting the body support 20 of the present invention to an associated main frame may be utilized as will be described below in connection with another embodiment of the present invention. Moreover, it is preferred that additional support of the box-spring 20, relative to the associated bed frame 12, be provided by a plurality of rods or cables 7 extending between and connected to the head and foot sections of the associated frame 12 below the body support 20. For example, FIGS. 5 and 6 disclose two runs of such supporting rods or cables 7. Each of these rods or cables consists of a series of links or sections which are pivotally interconnected to each other in articulated fashion to be able to fold together with the bed frame.

Figure 11:
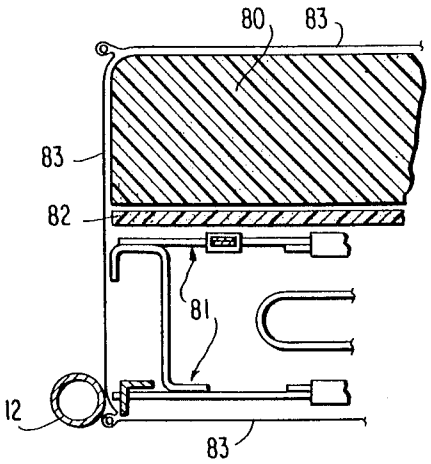
FIG. 11 is a view taken similar to FIG. 5 except it only shows a fragmental portion of a modification of the bed support wherein the mattress and box springs are combined into one unit.

The Modification of FIG. 11

Although in the embodiment described above, the body support unit, which is in the category of a box-spring, is formed as a unit separate from the outer mattress or pad 16, the two may be incorporated into a single outer case as a unit. This is illustrated, by way of example, in the modification shown in FIG. 11 wherein there is shown an outer mattress or pad 80 such as may be made from any suitable mattress material such as foam, overlying a spring unit of the present invention generally designated 81, with a layer of sheet material 82 inserted therebetween as a buffer. All of the aforementioned elements are contained within an outer case 83 which may be formed from any suitable ticking material or other sheet materials so that the mattress 80, together with the underlying box-spring, may be provided as a single unit. In all other respects, the body support of FIG. 11 may be utilized together with a sofa bed or seat bed or any other similar structure to operate in the same manner as described above to provide a body support whose depth may be reduced when not in use and expanded when in use.

Figure 12:
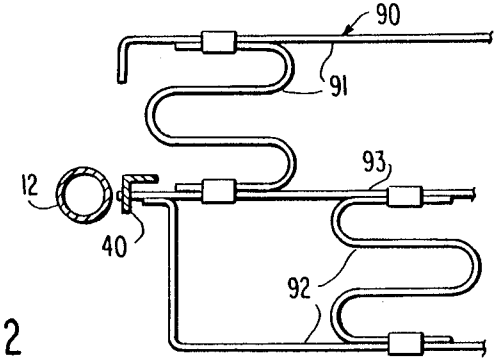
FIG. 12 is a fragmental, transverse cross-sectional view of another modification of the body support when in the operative, expanded condition.

The Modification of FIG. 12

If it is desired to provide a box-spring or a combination of box-spring and mattress having a greater overall depth than that described above, the height of the springs may be increased accordingly. Thus, for example, as illustrated in FIG. 12, the box-spring may include a spring generally designated 90, including an upper section 91 and a lower section 92 which are fixed relative to each other as a unit for pivoting about an axis 93 which is formed by a center-wire 93 incorporated in the spring 90 so as to be mounted within an associated frame 40 for rotation in order to extend or retract the spring 90. In this specific embodiment, note that the lower section 92 of the spring 90 would project downwardly below the main frame 12 when in the extended or erect position. This spring configuration may be actuated in any suitable manner including the actuating mechanism described above.

The Modification Of FIGS. 10A And 10B

Although in the above-described embodiments, the springs of the body support are mounted in an associated spring frame which, in turn, is mounted to the main support frame 12 of the associated bed or seat structure, it will be obvious that in other embodiments, the springs may be mounted directly to the main support frame 12. This is illustrated in the modification shown in FIGS. 10A and 10B wherein the springs 95 are mounted in apertures 96 formed through the main frame structure 12 and are retained in place by any suitable caps or locking fasteners 97 or other means.

Figures 13A, 13B, 13C:
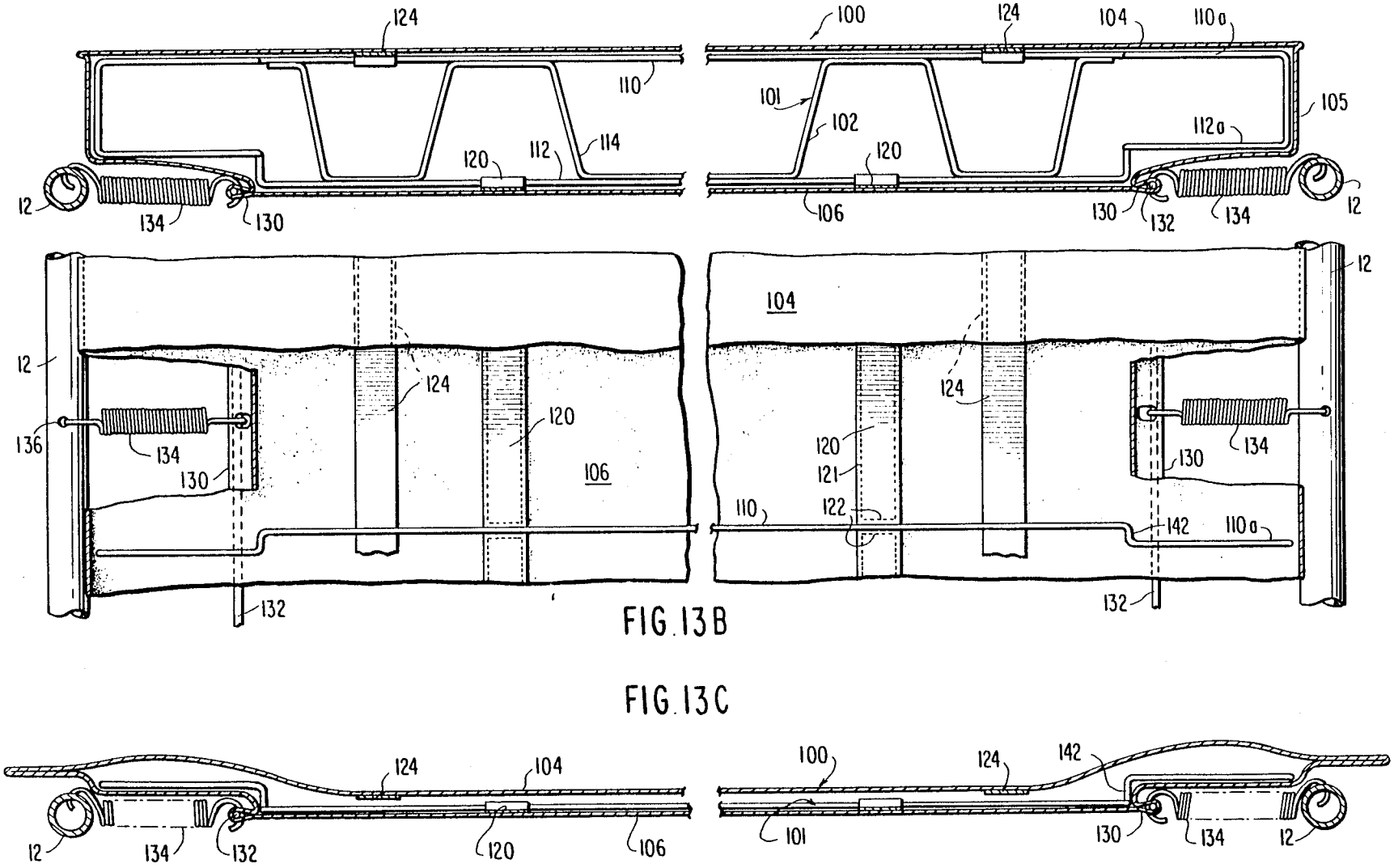
FIG. 13A is a transverse cross-sectional view of a sofa bed incorporating another embodiment of the present invention and shown in the bed mode.
FIG. 13B is a fragmental, plan view of the sofa bed of FIG. 13A with portions removed to show the internal construction.
FIG. 13C is a view similar to FIG. 13A but when the sofa bed is in the folded, sofa mode.

The Embodiment Of FIGS. 13A To 13C

Referring now to FIGS. 13A through 13C, there is shown another embodiment of the body support of the present invention generally designated 100. In the present embodiment, the springs generally designated 101 (only one shown), are fully contained in a case which may be formed of any suitable material as in the above-described embodiment. In the present embodiment, the case includes a top sheet 104 preferably made from polyethylene sheet material or other durable material, opposite side and end portions or skirts 105 and a bottom sheet 106 all, of course, joined together to fully enclose the springs. Springs 101 may have any suitable configuration and in the embodiment shown include elongated upper wires or rods 110, elongated bottom wires or rods 112 and intermediate spring members of similar material 114 which extend between and are fixed to upper and lower members 110 and 112 in any suitable manner such as by welding or clamping, etc. The shape of the intermediate spring members 114 may be designed as desired, however, in the specific embodiment shown, they form undulating U-shaped configurations extending from one end portion to the other end portion of the spring 101. Intermediate spring members 114 lie in the same plane as the upper and lower spring members 110 and 112 with the exception at the opposite ends of the springs, where the upper and lower spring members **110*a* and 112*a* (see FIGS. 13A and 13B) are offset from the main plane of spring 101 by offset portions 142. Also note in FIG. 13A that the bottom spring members 112*a* at the opposite ends of the spring are elevated relative to the main sections of bottom members 112. The purpose of this construction is to accommodate mounting springs 134 when the springs 101 are in the retracted position shown in FIG. 13C** as will become clear below.

Each of the springs 101 are held within the case at fixed locations extending transversely, while spaced longitudinally of the unit, by holding the lower members 112 of the springs to the bottom sheet 106 of the case. This may be effected in any suitable manner as long as each spring 101 is permitted to pivot or rotate about the axis of the bottom spring member 112 relative to the bottom sheet 106 of the case. In the specific embodiment shown, this attachment is achieved by elongated ribs or straps 120 attached such as by sewing, bonding or otherwise to the inside surface of the bottom sheet 106 to extend longitudinally throughout the latter and over the bottom members 112 of the springs 101. As shown in FIG. 13B, the straps 120 are also stitched at 122 to the bottom sheet 106 on opposite sides of the bottom member 112 of each spring so as to define a passage extending transversely of the strap 120 for receiving the bottom member 112 of the spring. Thus, while the straps 120 locate each of the springs 101, the springs are free to rotate about their bottom members 112 into the extended and retracted positions similar to springs 30 described above.

In order to integrate the springs 101 to enhance support as well as to allow them to be actuated between their extended and retracted positions, connecting members are provided interconnecting the various springs. In the specific embodiment shown, the connecting members may again be strapping members generally designated 124 applied to the upper members 110 of each of the springs in the same manner utilized in the embodiment described above.

Any suitable actuating mechanism may be provided for actuating the springs 101 between their retracted and extended positions with the aid of the connecting members 124 for transmitting motion to all of the springs. Although not shown, the actuating mechanism utilized in the above-described embodiment, may also be utilized in the present embodiment.

It should be apparent that the body support 100 is a self-contained unit and may be mounted to the associated main frame 12 by several methods, one being disclosed in FIGS. 13A through 13C. This includes a plurality of coil tension springs 134, each having one end mounted in an aperture 136 in the frame 12 and an opposite end hooked about perimeter rods or cable 132 located within the case along the perimeter preferably adjacent the perimeter of the lower sheet 106 of the case. In the specific embodiment, portions of the skirt 105 and the bottom sheet 106 of the case may be attached together such as by stitching or otherwise to form perimeter channels 130 for receiving the perimeter rods 132. The inner ends of the mounting springs 134 are hooked through apertures in the perimeter channels 130 and about the perimeter rods 132 to thereby mount the body support relative to the frame 12. Although not shown in FIGS. 13A through 13C, the perimeter rods or cables 132 will each consist of a series of sections or links pivotally interconnected to each other in articulated fashion at positions corresponding to the pivot points of the associated bed frame 12 to allow the body support to be folded harmoniously together with the bed frame 12 between the sofa and bed positions. As shown in FIGS. 13A and 13C, the offset end portions 110*a* and 112*a* of each of the springs 101 provides a recess which accommodates the spring mounting members 134. It will also be understood that the body support is mounted by as many mounting springs 134 as is desired in order to provide the proper support relative to the main frame 12.

In use, the body support 100 will be movable between an expanded condition shown in FIG. 13A where the springs 101 (only one shown) are all extending generally in a vertical plane and with the case in a relatively taut condition; and a depressed condition shown in FIG. 13C where the body support has been greatly reduced in depth to a thin layer which highly facilitates folding into the associated sofa or seat. The aforementioned conversion is effected by extending or retracting the springs 101 through the use of a suitable actuating mechanism such as the one described above.

It will be understood that the body support 100 as well as the body support 20 described above, may be used with or without an associated mattress or pad positioned upon the body support. Moreover, the body support 100 may be incorporated together with a top pad or mattress in a single case similar to that described above in connection with FIG. 11.

It will be seen from the above that the present invention is highly unique and solves the long-standing drawback with sofa beds, seat beds and similar structures and now permits these items to be styled as desired and at the same time provide comfortable body support for the user.

It should be understood that the size, shape, number and spacing of the springs of the body support of the present invention may be designed to provide soft, medium or firm body support. In addition, various types of ticking material may be utilized in constructing the body support of the present invention. Additionally, the present invention may be mounted to new, old or conventional sofa bed frames or similar structures where it will replace the conventional spring supports that have been heretofore incorporated in such frames while at the same time, providing significantly improved body support.

Although in the particular embodiments described above, the body support of the present invention has been utilized in conjunction with foldable bed structures such as sofa beds, etc., the present invention may be employed to provide a mattress or a box-spring for a standard nonfoldable bed. In this application, the present invention will greatly reduce the storage space of such mattresses since they may be shipped in the depressed condition to the points of use, whereupon they may be expanded and installed in conventional beds. Any suitable actuating means may be employed to actuate the springs between their retracted and extended positions.

Although the present invention has been disclosed in conjunction with certain embodiments thereof, it will be understood that other embodiments and modifications of the present invention will become readily apparent from the above and will lie within the scope of the invention which is indicated in the appended claims.

What is claimed is:

1. A body support for use in a bed or seat, the body support including a case, a plurality of resilient support members received in the case and being movable between a retracted inoperative uncompressed position and an erect operative position for supporting a body, and actuating means for moving said resilient members from said erect position to said retracted position and from said retracted position to said erect position, and wherein said case has an upper portion movable by said resilient members to an upper position when the resilient members are moved to their erect position and movable to a lower position when the resilient members are moved to their retracted position, wherein said actuating means includes means interconnecting a plurality of said resilient supports for transmitting movement therebetween.

2. The body support defined in claim 1 wherein said actuating means includes connecting means interconnecting said resilient members, and wherein said actuating means is connected to at least one of said resilient members for moving it to said erect position thereof, said connecting means serving to transmit movement to said other members for moving them to said erect position.

3. The body support defined in claim 2 further including mounting means mounting said resilient members for pivotal movement between said positions thereof about pivotal axes.

4. The body support defined in claim 3 wherein said resilient members are spaced laterally from each other along a longitudinal dimension of said body support substantially throughout said body support and have portions generally coinciding with said pivotal axes.

5. The body support defined in claim 3 wherein said mounting means includes mounting members extending along opposite sides of the body support, said resilient members having opposite ends pivotally mounted to said mounting members.

6. The body support defined in claim 4 wherein said resilient members extend generally in the same plane when in their retracted position and project from said plane when in the erect position.

7. The body support defined in claim 4 wherein said resilient members extend generally parallel to each other transversely of the body support.

8. The body support defined in claim 2 wherein said connecting means includes at least one elongated flexible tie member interconnecting upper portions of said resilient members.

9. The body support defined in claim 8 having a head end and an opposite foot end and wherein said tie member is anchored at one end of the head end of said body support.

10. The body support defined in claim 2 wherein said resilient members include an endmost resilient member located at the head end of the body support and wherein said actuating means includes means operatively interconnecting said endmost resilient member with one of said other resilient members for moving said endmost resilient member to erect position.

11. The body support defined in claim 10 wherein said endmost resilient member moves between its erect and retracted positions in directions opposite to that of said one of said other resilient members.

12. The body support defined in claim 1 wherein said resilient members include springs each having elongated upper and lower resilient run extending generally transversely of the body support to opposite sides thereof, and resilient intermediate members extending between and connected to said upper and lower runs.

13. The body support defined in claim 12 wherein said resilient members extend in generally the same plane when in the retracted position and project from said plane when in said erect position.

14. The body support defined in claim 12 further including means mounting said resilient members for pivotal movement between said erect and retracted positions about axes extending through said lower runs.

15. The body support defined in claim 12 wherein said upper and lower runs of each resilient member extend generally in the same plane but are offset from said plane at opposite ends thereof.

16. The body support defined in claim 1 further including a mattress overlying said resilient members.

17. The body support defined in claim 16 wherein said mattress is received within said case.

18. The body support defined in claim 1 wherein said resilient members extend in generally the same plane when in the retracted position and project from said plane when in said erect position.

19. The body support defined in claim 1 wherein said case is formed of flexible sheet material and wherein there is further included a buffer layer of flexible material between said resilient members and said upper portion of the case.

20. The body support defined in claim 1 further including means along opposite sides thereof for mounting the body support to a frame of an associated bed or seat.

21. A body support for use in a bed or seat, the body support including a case, a plurality of resilient support members received in the case and being movable between a retracted inoperative position and an erect operative position for supporting a body, and actuating means for moving said resilient members between said erect and retracted positions thereof, and wherein said case has an upper portion movable by said resilient members between a lower position and an upper position when the resilient members are moved to their erect position, and wherein said actuating means includes connecting mans interconnecting said resilient members, and wherein said actuating means is connected to at least one of said resilient members for moving it to said erect position thereof, said connecting means serving to transmit movement to said other members for moving them to said erect position, and further including mounting means mounting said resilient members for pivotal movement between said positions thereof about pivotal axes, and wherein said mounting means includes mounting members extending along opposite sides of the body support, said resilient members having opposite ends pivotally mounted to said mounting members, and wherein said actuating means further includes means for moving at least one of said resilient members from said retracted to said erect position when the body support is folded upon itself, said connecting means being operable to transmit movement of said one resilient member to other resilient members to move the other resilient members into the erect position.

22. The body support defined in claim 21 wherein said mounting members are provided in sections on opposite sides of said body support and wherein said means for moving at least one of said resilient members includes a linkage interconnecting adjacent sections of said mounting members on one side of said body support.

23. The body support defined in claim 21 wherein said connecting means includes at least one elongated flexible tie member interconnecting upper portions of said resilient members.

24. The body support defined in claim 23 having a head end and an opposite foot end and wherein said tie member is anchored at one end at the head end of said body support.

25. The body support defined in claim 24 wherein said resilient members include an endmost resilient member located at the head end of the body support and wherein said actuating means includes means operatively interconnecting said endmost resilient member with one of said other resilient members for moving said endmost resilient member to erect position.

26. A foldable seat or bed structure comprising a foldable main support including portions movable between an operative unfolded position extending in a generally horizontal plane and a folded position lying in spaced planes, a resilient body support mounted on and foldable together with the main support, said body support being movable between a retracted inoperative position when said main support portions are in said folded position thereof and an extended operative position when said main support portions are in said operative unfolded position thereof, actuating means for moving said body support between said operative and inoperative positions thereof in response to movement of said main support portion between said positions thereof, and mounting means mounting said resilient members for pivotal movement between said positions thereof about pivotal axes.

27. The structure defined in claim 26 wherein said resilient body support includes a plurality of resilient members movable between a retracted position and an erect position for supporting a body, said actuating means serving to move said resilient members between said positions thereof.

28. The structure defined in claim 27 wherein said mounting means includes mounting members extending along opposite sides of the body support in sections corresponding to said portions of the main support, said resilient members having opposite ends pivotally mounted in said mounting members.

29. The structure defined in claim 28 wherein at least one of said resilient members has opposite ends pivotally mounted in said main support.

30. The structure defined in clam 27 wherein said mounting means includes apertures in said main frame pivotally receiving opposite ends of said resilient members.

31. The structure defined in claim 28 wherein said support member includes a case receiving said resilient members and said mounting members, and wherein there is further included means mounting the body support to said main frame, said last-defined means includes means interconnecting said mounting members and said main frame.

32. The structure defined in claim 27 further including a case receiving said resilient members, and wherein there is further included mounting members in the case extending along opposite ends of the resilient members, and means mounting said body support to said main frame including means interconnecting said mounting members and said main frame.

33. The structure defined in claim 32 wherein said mounting means mounting said resilient members for pivotal movement includes means connected to a bottom portion of the case.

34. A foldable bed or seat structure comprising in combination, a foldable main support including frame portions movable between an operative unfolded position extending in a generally horizontal plane and a folded position lying in spaced planes, a foldable box-spring mounted on said main support to be movable with the main support between said positions thereof, a mattress mounted on said box-spring to be foldable therewith together with the main support, and means for contracting said box-spring along its depth dimension into a position adjacent said frame portions in response to folding of the main frame to said folded position thereof and wherein said last-defined means includes means for erecting said box-spring along its depth dimension into a position spaced above said frame portions in response to unfolding of the main frame to said operative unfolded position thereof.

35. The structure defined in claim 34 further including a flexible case enclosing said mattress and box-spring.

36. A foldable bed or bed structure comprising in combination a foldable main support including portions movable between an unfolded position extending in a generally horizontal plane and a folded position lying in spaced planes, a box-spring including pivotal spring members, said box spring being mounted on and foldable together with the main support and having means for contracting the box-spring along its depth dimension without compressing said spring members when said main support portions are moved to said folded position thereof and for expanding the box-spring along its depth dimension when said main support portions are moved to said unfolded position thereof.

37. The combination defined in claim 36 further including a mattress mounted on the box-spring and foldable together with the box-spring and the main support.

38. In a body support such as a mattress or box spring, resilient means for supporting a body, means mounting said resilient means for movement between a first inoperative retracted position and a second operative erect position for supporting a body, and means for actuating said resilient means between said inoperative and operative positions thereof and wherein at least one portion of the body support is foldable and unfoldable upon or away from another portion thereof, and wherein said means for actuating said resilient means is responsive to unfolding or folding the body portion to move said resilient means from said retracted position to said operative position or from said operative position to said retracted position and wherein there is further included a case containing said resilient means and being movable between a distended position when the resilient means is in said operative position and a depressed position when said resilient means is in said inoperative retracted position.

39. In a body support for use in a bed or a seat, a plurality of resilient support members, and actuating means for moving the resilient support members from a collapsed inoperative position to an erect operative position for providing resilient support and from the erect position to the collapsed inoperative position for storage or handling, and a case containing said resilient members and movable with said resilient members between said erect and collapsed positions thereof, wherein said actuating means includes means interconnecting a plurality of said resilient support members for transmitting movement therebetween.

40. A body support for use in a bed or seat, the body support including a case, a plurality of resilient members received in the case and being movable between a retracted inoperative position and an erect operative position for supporting a body, and actuating means for moving said resilient members between said erect and retracted positions thereof, and wherein said case has an upper portion movable by said resilient members between a lower position and an upper position when the resilient members are moved to their erect position, and the body support being constructed to be foldable upon itself and wherein said actuating means is responsive to folding the body support to move said resilient members from their retracted to erect position.

41. A body support for use in a bed or seat, the body support including a case, a plurality of resilient members received in the case and being movable between a retracted inoperative position and an erect operative position for supporting a body, and actuating means for moving said resilient members between said erect and retracted positions thereof, and wherein said case has an upper portion movable by said resilient members between a lower position and an upper position when the resilient members are moved to their erect position, wherein said resilient members include springs each having upper, lower and intermediate generally parallel resilient runs and intermediate members extending between and connected to the upper and intermediate runs and the lower and intermediate runs, and wherein there is further included means mounting said springs for pivotal movement between said retracted and erect positions about axes extending generally through said intermediate runs.

42. A body support for use in a bed or seat, the body support including a case, a plurality of resilient members received in the case and being movable between a retracted inoperative position and an erect operative position for supporting a body, and actuating means for moving said resilient members between said erect and retracted positions thereof, and wherein said case has an upper portion movable by said resilient members betwen a lower position and an upper position when the resilient members are moved to their erect position, wherein said case includes a bottom portion underlying said resilient membes and there is further included means mounting said resilient members to said bottom portion of the case for pivotal movement between said extended and retracted positions thereof.

43. A box-spring or mattress structure for a bed or seat including a case of flexible material and resilient support means within the case for expanding and contracting the case along a depth dimension of the case between first and second predetermined positions, means for moving said resilient support means between a retracted position for contracting the case and an erect position for expanding the case between said positions thereof, and wherein the box spring or mattress structure is constructed to be foldable upon itself and wherein there is further included actuating means for moving said resilient support means to said retracted position in response to folding of the structure upon itself.

44. A body support for a bed or seat comprising a case, support means within the case for raising and lowering the case along a depth dimension of the case between first and second predetermined positions, means for moving said support means between a retracted position for lowering the case and an erect position for raising the case between said positions thereof, said body support being foldable upon itself and wherein there is further included means for moving said support means to said retracted position in response to folding of the structure upon itself and for moving said support means to said erect position in response to unfolding of the body support.

45. A foldable seat or bed structure comprising in combination, a foldable main support including frame portions movable between an operative unfolded position extending in a generally horizontal plane and a folded position lying in spaced planes, a body support mounted on and foldable together with the main support, said body support including an upper support surface movable between a depressed inoperative position situated adjacent said frame portions when said frame portions are in said folded position thereof and an erected operative position substantially spaced away from said frame portions when said frame portions are in said operative unfolded position thereof, and means for moving said support surface to said erected operative position in response to movement of said main support portions to said unfolded position thereof and for moving said support surface to said depressed inoperative position in response to movement of said main support portions to said folded position.

* * * * *